US010510525B2

(12) United States Patent
Grinfeld et al.

(10) Patent No.: US 10,510,525 B2
(45) Date of Patent: Dec. 17, 2019

(54) ION BEAM MASS PRE-SEPARATOR

(71) Applicants: Thermo Fisher Scientific (Bremen) GmbH, Bremen (DE); Thermo Finnigan LLC, San Jose, CA (US)

(72) Inventors: Dmitry E. Grinfeld, Bremen (DE); Mikhail V. Ugarov, San Jose, CA (US); Viatcheslav V. Kovtoun, Santa Clara, CA (US); Alexander A. Makarov, Bremen (DE)

(73) Assignees: Thermo Fisher Scientific (Bremen) GmbH, Bremen (DE); Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 16/245,023

(22) Filed: Jan. 10, 2019

(65) Prior Publication Data

US 2019/0164738 A1 May 30, 2019

Related U.S. Application Data

(63) Continuation of application No. 15/060,474, filed on Mar. 3, 2016, now Pat. No. 10,199,208.

(51) Int. Cl.
*H01J 49/00* (2006.01)
*H01J 49/42* (2006.01)

(52) U.S. Cl.
CPC ..... *H01J 49/427* (2013.01); *H01J 49/0031* (2013.01); *H01J 49/423* (2013.01); *H01J 49/4255* (2013.01)

(58) Field of Classification Search
CPC ..... H01J 49/427; H01J 49/0031
(Continued)

(56) References Cited

U.S. PATENT DOCUMENTS 5,206,506 A 4/1993 Kirchner
6,762,406 B2 7/2004 Cooks et al.
(Continued)

FOREIGN PATENT DOCUMENTS

CN 203445097 U 8/2011
WO 00/70335 A2 11/2000
(Continued)

OTHER PUBLICATIONS

Graham, et al., "First Distance-of-Flight Instrument: Opening a New Paradigm in Mass Spectrometry", J. Am. Soc. Mass Spectrom. (2011) 22, pp. 110-117.

*Primary Examiner* — Michael Maskell
(74) *Attorney, Agent, or Firm* — David A. Schell

(57) ABSTRACT

An apparatus for separating ions includes an electrode arrangement having a length extending between first and second ends. The first end is configured to introduce a beam of ions into an ion transmission space of the arrangement. An electronic controller applies an RF potential and a DC potential to an electrode of the electrode arrangement, for generating a ponderomotive RF electric field and a mass-independent DC electric field. The application of the potentials is controlled such that a ratio of the strength of the ponderomotive RF electric field to the strength of the mass-independent DC electric field varies along the length of the electrode arrangement. The generated electric field supports extraction of ions having different m/z values at respective different positions along the length of the electrode arrangement. Ions are extracted in one of increasing and decreasing sequential order of m/z ratio with increasing distance from the first end.

18 Claims, 14 Drawing Sheets

(58) Field of Classification Search
USPC ..... 250/281, 282, 290, 292–296
See application file for complete search history.

(56) References Cited

U.S. PATENT DOCUMENTS

| | | | | |
|---|---|---|---|---|
| 6,960,761 | B2 | 11/2005 | Clemmer | |
| 7,157,698 | B2 | 1/2007 | Makarov et al. | |
| 7,189,965 | B2 | 3/2007 | Franzen | |
| 7,196,327 | B2 | 3/2007 | Thomson et al. | |
| 7,309,861 | B2 | 12/2007 | Brown et al. | |
| 7,365,317 | B2 | 4/2008 | Whitehouse et al. | |
| 7,718,959 | B2 | 5/2010 | Franzen et al. | |
| 8,309,916 | B2 | 11/2012 | Wouters et al. | |
| 8,581,177 | B2 | 11/2013 | Kovtoun | |
| 9,607,817 | B1 * | 3/2017 | Ugarov ..... | H01J 49/0031 |
| 10,199,208 | B2 * | 2/2019 | Grinfeld ..... | H01J 49/423 |
| 2003/0213900 | A1 | 11/2003 | Hoyes | |
| 2008/0067349 | A1 | 3/2008 | Moskovets et al. | |
| 2012/0256083 | A1 * | 10/2012 | Kovtoun ..... | H01J 49/06 250/282 |
| 2015/0028198 | A1 * | 1/2015 | Grinfeld ..... | H01J 49/06 250/282 |
| 2015/0287585 | A1 * | 10/2015 | Kovtoun ..... | H01J 49/4295 250/283 |
| 2017/0076928 | A1 * | 3/2017 | Ugarov ..... | H01J 49/0031 |

FOREIGN PATENT DOCUMENTS

| | | | |
|---|---|---|---|
| WO | 03/103101 | A1 | 12/2003 |
| WO | 2004/008481 | A1 | 1/2004 |
| WO | 2004/085992 | A2 | 10/2004 |
| WO | 2013/076307 | A2 | 5/2013 |

* cited by examiner

ION BEAM MASS PRE-SEPARATOR

CROSS-REFERENCE TO RELATED APPLICATIONS

The present application is a continuation under 35 U.S.C. § 120 and claims the priority benefit of co-pending U.S. patent application Ser. No. 15/060,474, filed Mar. 3, 2016. The disclosure of the foregoing application is incorporated herein by reference.

FIELD OF THE INVENTION

The instant invention relates generally to the field of mass spectrometry. More particularly, the instant invention relates to an ion beam mass pre-separator for use with an ion source that produces a continuous ion flux.

BACKGROUND

A continuous flux electrospray or a plasma ion source may produce $10^{11}$-$10^{12}$ charges per second of which up to $10^{10}$ or more charges per second are expected to enter the mass analyzer. Ions that are produced in this way can be separated based on their mass-to-charge (m/z) ratios, and then detected to obtain a measure of the number of ions of each m/z ratio. The results of such an analysis are presented typically in the form of a mass spectrum.

In order to maximize sensitivity, all of the ions that are generated in the ion source should be detected at the detector. Unfortunately, this ideal condition is not achieved in practice for a variety of reasons. For instance, conventional sequential mass analyzers such as a quadrupole mass analyzer or a magnetic sector operate as scanning mass filters, which transmit ions within only a narrow range of m/z ratios at a time, and the full mass range of interest is scanned. Ions that have m/z ratios outside of the transmitted range at any given time are discarded without contributing to the detected ion signal, and as a result the analytical throughput is reduced.

Panoramic mass analyzers such as time-of-flight, orbital trapping or Fourier-transform ion cyclotron resonance are able to detect over a wide mass range and this has facilitated their broad acceptance in life science mass spectrometry. However, high complexity of analyzed mixtures requires additional selectivity of analysis that is usually enforced by adding mass filters in order to concentrate on a narrow mass range only. Mass filtering is frequently accompanied by fragmentation of ions in that range and measurement of fragments for purposes of identification and quantitation (so called MS/MS mode). Such instruments yield high-resolution, high mass-accuracy fragment spectra and have been used in accordance with various methods of targeted and untargeted analysis. Of course, while all fragments are analyzed in parallel the different precursor compounds are selected one at a time, and accordingly relatively more time is needed to obtain high-quality spectra of low-intensity precursors. As a result, the practical throughput of such systems remains low.

Other solutions based on multi-channel MS/MS have also been proposed, in which each of a plurality of parallel mass analyzers is used to select one precursor compound and scan out its fragments to an individual detector. Examples of such systems include: the ion trap arrays disclosed in U.S. Pat. Nos. 5,206,506 or 7,718,959; the multiple traps disclosed in U.S. Pat. No. 6,762,406; and the multiple TOFs disclosed in US PG-PUB No. 2008/0067349. Such arrays speed up the analysis but typically this is achieved at the cost of poor utilization of the sample stream for each particular element of the array, since each element of the array is filled either sequentially or from its own source.

In a different approach, improved throughput is achieved by separating the ion beam into packets or groups of multiple precursor ion species, each group containing ions having an m/z value or another physico-chemical property (e.g. cross-section) that lies within a window of values, and each group is fragmented without the loss of the other groups, or multiple groups are concurrently and separately fragmented. Such parallel selection potentially supports utilization of the analyte to its full extent. Several configurations have been suggested, including: a scanning device that stores ions of a broad mass range (e.g. a 3D ion trap as disclosed in PCT Publication No. WO 03/103010, or a linear trap with radial ejection as disclosed in U.S. Pat. No. 7,157,698); pulsed ion mobility spectrometer (as disclosed in PCT Publication No. WO 00/70335, US 2003/0213900, U.S. Pat. No. 6,960,761, e.g. so-called time-aligned parallel fragmentation, TAPF); slowed-down linear (WO 2004/085992) or multi-reflecting TOF mass spectrometer (WO 2004/008481); or even magnetic sector instruments.

In all cases, the first stage of ion separation into distinct ion groups based on m/z or cross-sections is followed by fast fragmentation, e.g. in a collision cell (preferably with an axial gradient) or by a pulsed laser. Then fragments are analyzed (preferably by a TOF analyzer) on a much faster time scale than the scanning duration, although performance is constrained by the very limited time that is allocated for each scan (typically, 50-200 μs).

In practice, all such parallel selection methods suffer from one or all of the following drawbacks: relatively low resolution of precursor selection; insufficient space charge capacity of the trapping device (which frequently negates all advantages of parallel separation); cumbersome control of ion populations; relatively low resolving power of fragment analysis; and low mass accuracy of fragment analysis.

Various approaches have been suggested to decouple fragment analysis from parallel selection. In WO 2013/076307, Makarov discusses an ion separator that is based on selective orthogonal ejection of ions from a linear quadrupole RF trap, which is being filled continuously with ions. The ions are released from the RF trap using mass-selective orthogonal alternating-current (AC) excitation at scanning frequency. The separator may be operated with an input ion flux up to about $10^8$ charges per second. Unfortunately, the resolving power is significantly deteriorated due to the space charge that is accumulated in the RF trap.

U.S. Pat. No. 8,581,177 addresses the problems that are associated with ion storage limitations of the trapping devices in parallel selection methods. In particular, a high capacity ion storage/ion mobility instrument is disposed as an interface between an ion source inlet and a mass spectrometer. The high capacity ion storage instrument is configured as a two-dimensional (2D) array of a plurality of sequentially arranged ion confinement regions, which enables ions within the device to be spread over the array, each confinement region holding ions for mass analysis being only a fraction of the whole mass range of interest. Ions can then be scanned out of each confinement region and into a respective confinement cell (channel) of a second ion interface instrument. Predetermined voltages are adjusted or removed in order to eliminate potential barriers between adjacent confinement cells so as to urge the ions to the next (adjacent) confinement cell, and this is repeated until the ions are eventually received at an analyzer. The ions are therefore transported in a sequential fashion from one confinement cell to the next, and as such it is possible only to analyze each group of ions in a predetermined order that is based on the original ion mobility separation. In particular, the approach that is proposed in U.S. Pat. No. 8,581,177 does not support a method of analyzing the confined groups of ions in an on-demand fashion.

This limitation is overcome in US 2015/0287585A1 where an ion storage array of independently operable storage cells allows analysing such confined groups of ion in an on-demand fashion. However, separation of ions into storage cells is also implemented by using a pulsed ion mobility device that requires storage prior to separation.

Unfortunately, all the above-noted methods are based on using trapping devices prior to or integrated with the separator to provide high duty cycle of its operation, and the cycle time is defined by the cycle time of the separator. As mentioned above, modern ion sources produce ion currents in vacuum in the range of hundreds to thousands of pA, i.e. $>10^9$ to $10^{10}$ elementary charges/second. Assuming a full cycle of scanning through the entire mass range of interest is 5 ms, then such trapping devices should be able to accumulate at least 5-50 million elementary charges and still allow efficient precursor selection.

It would therefore be beneficial to provide a system and method that avoids high space charge building up in the separator as may occur in the prior art devices.

SUMMARY OF THE INVENTION

In a mass spectrometric system, a continuous input ion flux is pre-separated into N beams of extracted ions or beamlets, each different beamlet comprising ions having mass-to-charge (m/z) ratios in a different predetermined range. The beamlets are provided to a detection system that optionally includes a sequential mass analyzer, e.g. a quadrupole mass filter. Advantageously, this sequential mass analyzer may further filter a smaller m/z range from each ion beamlet, relative to the m/z range of the continuous input ion flux. Different implementations may be envisaged. In one implementation the beamlets are analysed in parallel using N individual mass analyzers each analysing a N-times smaller mass range, thus increasing utilization of incoming ion current by a factor of up to N (in the simplest case of uniform distribution of ion current over mass range). In an alternative implementation the ions in the beamlets are stored in N separate ion storage cells or traps e.g. radiofrequency (RF) traps, which are subsequently emptied into a common mass analyser, one m/z range at time. In this approach the mass analyzer scans through each of the different predetermined m/z ranges one at time, while the ions with m/z ratios within different ranges continue to be stored and accumulated in the traps of the array of traps.

In accordance with an aspect of at least one embodiment, there is provided an apparatus for separating ions spatially and in sequential order of mass-to-charge (m/z) ratio, the apparatus comprising: an electrode arrangement having a length extending in an axial direction between a first end thereof and a second end thereof, the second end opposite the first end, and the first end being configured to introduce a beam of ions into an ion transmission space of the electrode arrangement, the beam of ions comprising ions having m/z ratios within a first range of m/z ratios; and an electronic controller in electrical communication with the electrode arrangement and configured to apply an RF potential and a DC potential to at least an electrode of the electrode arrangement for generating a ponderomotive RF electric field and a mass-independent DC electric field, such that a ratio of the strength of the ponderomotive RF electric field to the strength of the mass-independent DC electric field varies along the length of the electrode arrangement, wherein the generated electric field supports the extraction of ions having different m/z values at respective different positions along the length of the electrode arrangement, in one of increasing and decreasing sequential order of m/z ratio with increasing distance from the first end.

In accordance with an aspect of at least one embodiment, there is provided a mass spectrometer system, comprising: a continuous flux ion source for producing a beam of ions comprising ions having a first range of mass-to-charge (m/z) ratios; an ion flux separator disposed in fluid communication with the ion source and comprising: an electrode arrangement having a length extending in an axial direction between a first end thereof and a second end thereof, the second end opposite the first end, and the first end configured to introduce the beam of ions from the continuous flux ion source into an ion transmission space of the electrode arrangement; and an electronic controller in electrical communication with the electrode arrangement and configured to apply an RF potential and a DC potential to at least an electrode of the electrode arrangement for generating a ponderomotive RF electric field and a mass-independent DC electric field, such that a ratio of the strength of the ponderomotive RF electric field to the strength of the mass-independent DC electric field varies along the length of the electrode arrangement and ions having different m/z ratios exit from the electrode arrangement at different respective locations along the length of the electrode arrangement and form a plurality of separate ion beamlets, each ion beamlet consisting essentially of ions having m/z ratios within a different second range of m/z ratios, and each second range of m/z ratios being within the first range of m/z ratios; and at least one mass analyzer in fluid communication with the ion flux separator for receiving separately each one of the separate ion beamlets.

In accordance with an aspect of at least one embodiment, there is provided a method for separating ions spatially and in sequential order of mass-to-charge (m/z) ratio, the method comprising: using a continuous flux ion source, producing a beam of ions having mass-to-charge (m/z) ratios within a predetermined first range of m/z ratios; introducing the beam of ions into an ion flux separator that is disposed between the ion source and at least one mass analyzer, the ion flux separator having a length extending in an axial direction; applying an RF potential and a DC potential to at least an electrode of the ion flux separator, thereby establishing a ponderomotive RF electric field and a mass-independent DC electric field, the RF potential and the DC potential applied such that a ratio of the strength of the ponderomotive RF electric field to the strength of the mass-independent DC electric field varies along the length of the ion flux separator; extracting ions having different m/z ratios at different respective locations along the length of the ion flux separator, the extracted ions forming a plurality of separate ion beamlets, each ion beamlet consisting essentially of ions having m/z ratios within a different second range of m/z ratios, and each second range of m/z ratios being within the first range of m/z ratios; and using the at least one mass analyzer, receiving separately each of the plurality of separate ion beams for performing in aggregate an analysis of the introduced ion beam.

BRIEF DESCRIPTION OF THE DRAWINGS

The instant invention will now be described by way of example only, and with reference to the attached drawings, wherein similar reference numerals denote similar elements throughout the several views, and in which.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
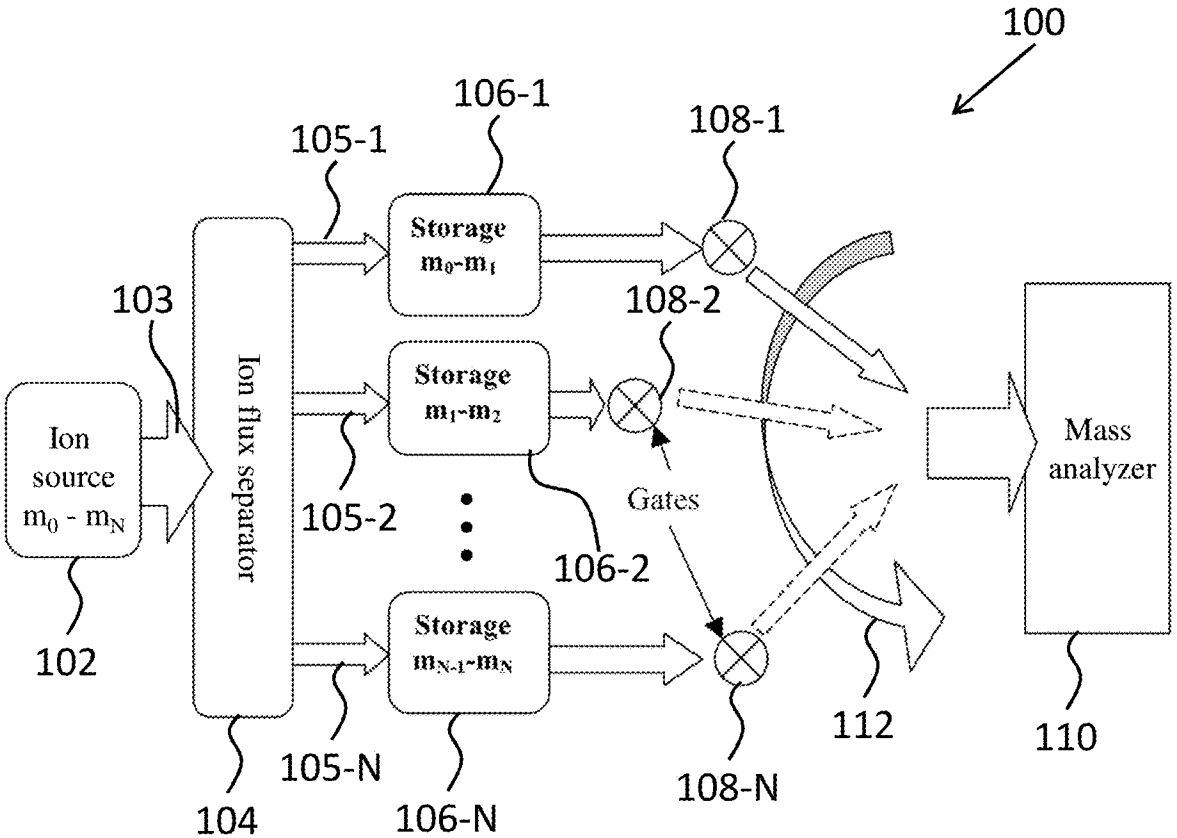
FIG. 1 is a simplified block diagram of a system according to an embodiment with a common mass analyzer.

Referring to FIG. 1, shown is a simplified block diagram of a system 100 according to an embodiment. Ion source 102 generates a continuous ion flux 103 comprising ions with mass-to-charge (m/z) ratios ranging from $m_0$ to $m_N$. Ion flux separator 104 divides the continuous ion flux 103 into N fractions (i.e., separate beams of extracted ions or beamlets 105-1 to 105-N) which are stored continuously in N separate ion storage cells 106-1 to 106-N. As shown in FIG. 1, ions in a predetermined first range of m/z ratios $m_0$ to $m_1$ are stored in a first ion storage cell 106-1, ions in a predetermined second range of m/z ratios $m_1$ to $m_2$ are stored in a second ion storage cell 106-2, and ions in a predetermined $N^{th}$ range of m/z ratios $m_{N-1}$ to $m_N$ are stored in a $N^{th}$ ion storage cell 106-N. Ion gates 108-1 to 108-N are first set such that gate 108-1 empties the storage cell 106-1, thereby allowing the ions in the predetermined first range of m/z ratios $m_0$ to $m_1$ to enter the mass analyser 110. By way of an example the mass analyser 110 is a sequential mass analyzer, the transmittance of which is being scanned in the m/z ratio range $m_0$ to $m_1$. While these ions are being analyzed, the ions in the range of m/z ratios $m_1$ to $m_n$ continue to be accumulated in the ion storage cells 106-2 to 106-N, instead of simply being discarded. Next, gate 108-1 is closed and gate 108-2 is opened such that ion storage cell 106-2 is emptied, thereby allowing the ions in the predetermined second range of m/z ratios $m_1$ to $m_2$ to enter the sequential mass analyser 110, which now filters m/z of interest from the m/z ratio range $m_1$ to $m_2$. While these ions are being analysed with or without subsequent fragmentation, the ions in the ranges of m/z ratios $m_0$ to $m_1$ and $m_2$ to $m_N$ continue to be accumulated, and accumulation in m/z range from $m_1$ to $m_2$ could be also resumed. The process repeats until ion storage cell 106-N is emptied, after which the entire cycle 112 repeats starting with ion storage cell 106-1. Optionally, the ion storage cells are emptied not in sequential order 106-1, 106-2 . . . 106-N, but rather depending on their content. For instance, different storage cells are filled for different lengths of time, and emptying of some of the storage cells may be skipped during certain repetitions of the mass analysis cycle 112. In this way, relatively lower abundance ions may be accumulated for longer periods of time than relatively higher abundance ions, and/or space-charge effects may be controlled, etc. Such scheduling of filling and ejection could be determined using a pre-scan over the entire mass range of analysis, as known in the art.

Figure 2:
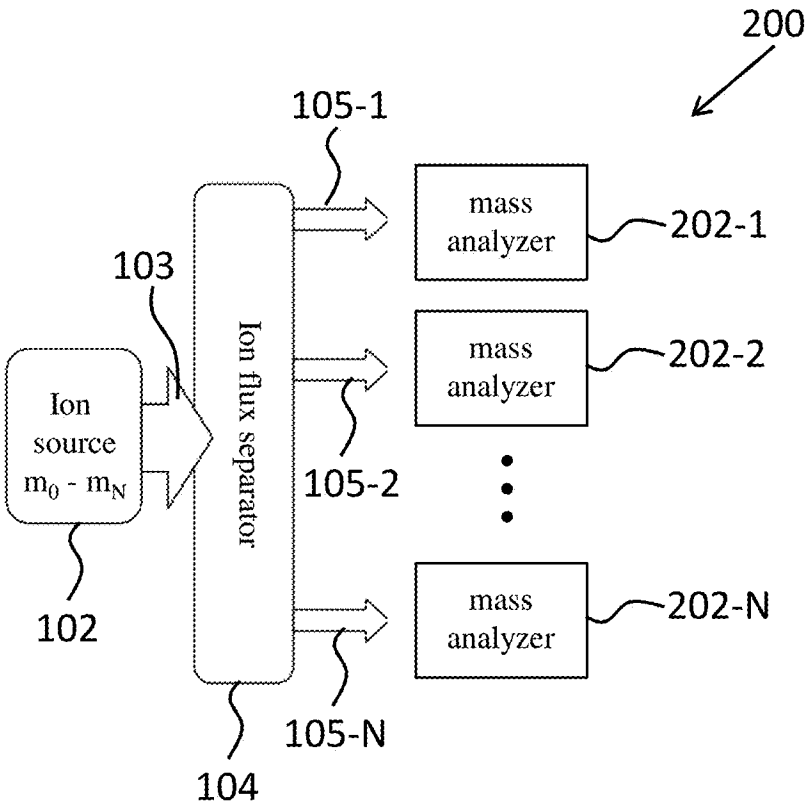
FIG. 2 is a simplified block diagram of a system according to an embodiment with an array of individual mass analyzers.

Referring now to FIG. 2, shown is a simplified block diagram of a system 200 according to an embodiment. Ion source 102 generates a continuous ion flux 103 comprising ions with mass-to-charge (m/z) ratios ranging from $m_0$ to $m_N$. Ion flux separator 104 divides the continuous ion flux 103 into N fractions (i.e., separate beams of extracted ions or beamlets 105-1 to 105-N) which are analysed using N individual mass analyzers 202-1 to 202-N arranged in parallel, the $k^{th}$ analyser scanning only the mass range between $m_{k-1}$ and $m_k$, thereby increasing utilization of incoming ion current by a factor of up to N (in the simplest case of uniform distribution of ion current over mass range). By way of an example, the individual mass analyzers 202-1 to 202-N are sequential mass analyzers.

Figure 3:
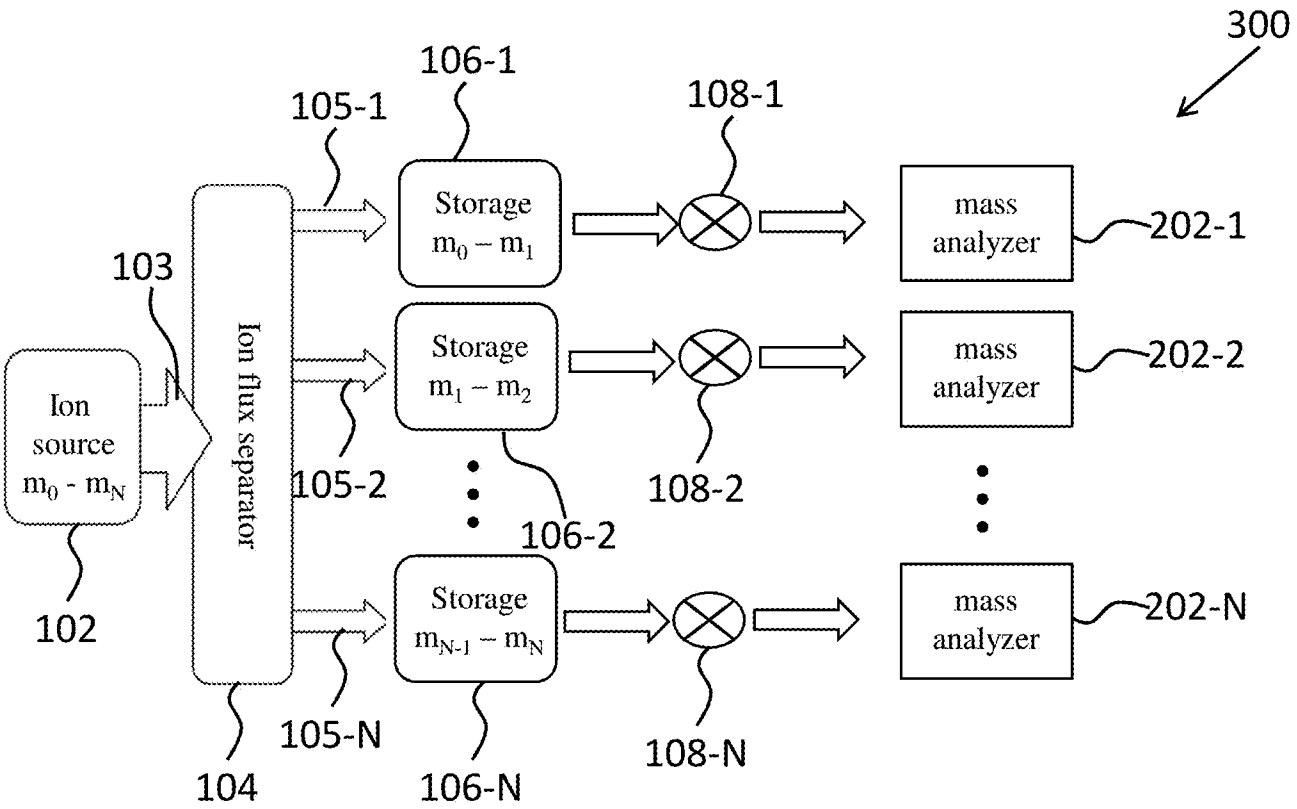
FIG. 3 is simplified block diagram of a system according to an embodiment with a storage array and an array of individual mass analyzers

Referring now to FIG. 3, shown is a simplified block diagram of a system 300 according to an embodiment. Ion source 102 generates a continuous ion flux 103 comprising ions with mass-to-charge (m/z) ratios ranging from $m_0$ to $m_N$. Ion flux separator 104 divides the continuous ion flux 103 into N fractions (i.e., separate beams of extracted ions or beamlets 105-1 to 105-N) which are stored continuously in N separate ion storage cells 106-1 to 106-N. Ion gates 108-1 to 108-N are controlled to empty the respective ion storage cells 106-1 to 106-N, thereby providing the N ion-fractions to N separate mass analyzers 202-1 to 202-N. By way of an example, the separate mass analyzers 202-1 to 202-N are sequential mass analyzers. System 300 may be operated such that beamlets with relatively higher ion abundances are analyzed directly using a respective mass analyzer, and beamlets with relatively lower ion abundances are first accumulated in a respective ion storage cell prior to being analyzed using a respective mass analyzer.

Figure 4:
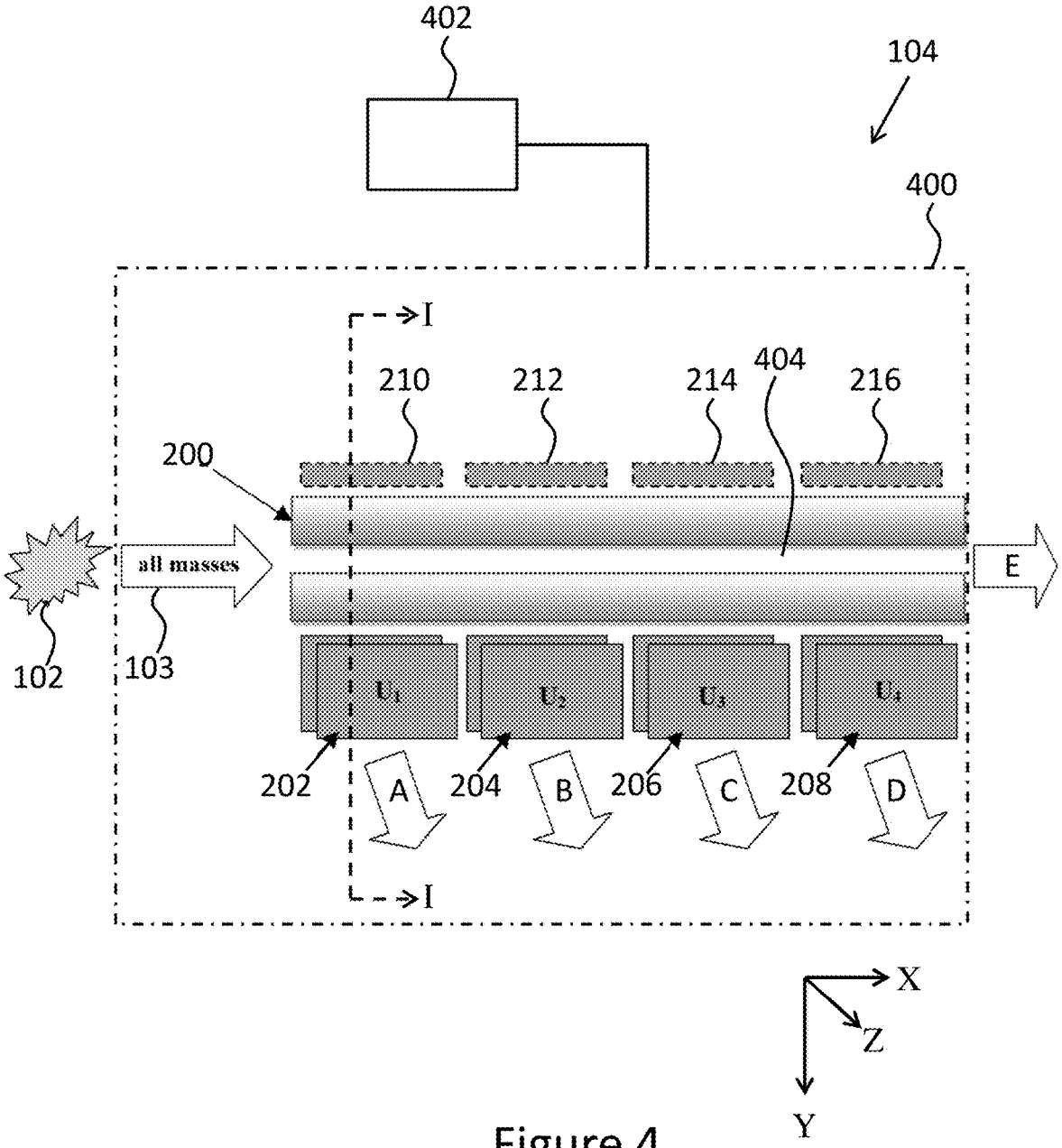
FIG. 4 is a simplified diagram showing major components of an ion flux separator according to an embodiment.

FIG. 4 is a schematic diagram illustrating the principle of operation of ion flux separator 104. Ion source 102 generates a continuous ion flux 103 containing ions with a wide range of mass-to-charge ratios. It is assumed the ions are positively charged, but alternatively negatively charged ions, or a mixture of positively and negatively charged ions, may be separated in the ion flux separator 104. The ion flux separator 104 comprises an electrode arrangement 400 (shown generally within the dash-dot line in FIG. 4) and an electronic controller 402 that is in electrical communication with the electrode arrangement 400. The ion flux 103 enters a central ion transmission space 404 between the electrodes of an RF multipole, which in this specific and non-limiting example is a linear quadrupole ion guide 200. Under the control of the electrical controller 402, the linear quadrupole ion guide 200 generates a ponderomotive potential barrier $\Psi(m)=C/m$, where the constant C depends on the RF amplitude, RF frequency and the ion guide's geometry. Also under the control of the electrical controller 402 the DC-biased extraction electrodes 202-208 are negatively biased, with respect to the quadrupole ion guide 200, respectively as $(-U_1)$ to $(-U_4)$. The absolute values of DC voltages increase in the direction of ion propagation (left to right in FIG. 4): $U_1<U_2<U_3<U_4$. Potential $U_1$ is chosen to overcome the ponderomotive potential barrier of height $\Psi(m_4)$ so that the ions with $m/z\geq m_4$ are not constrained in a first section of the quadrupole 200 that is adjacent to the electrodes 202 with DC potential $U_1$, and are ejected transversely at "A" in FIG. 4. The first section of the quadrupole 200 is one of a plurality of discrete "extraction regions" that is defined along the length of the quadrupole 200 between first and second ends thereof. As such, the rest of the ions propagate farther into a second section of the quadrupole ion guide 200 (the next discrete extraction region), which is adjacent to the electrodes 204 with the applied DC potential $U_2$ chosen to overcome the potential barrier $\Psi(m_3)$. The ions with $m_3\leq m/z<m_4$ are ejected transversely at "B" in FIG. 4. Similarly, the ions with $m_2\leq m/z<m_3$ are ejected transversely at "C" in FIG. 4 and the ions with $m_1\leq m/z<m_2$ are ejected transversely at "D" in FIG. 4. In this manner, all ions with $m/z\geq m_1$ are separated into groups with different ranges of m/z ratios. Finally, the lightest ions with $m_0\leq m/z<m_1$ leave the quadrupole 200 on the distant end at "E" in FIG. 4. Optional compensating electrodes 210-216 have positive DC biases opposite to that of electrodes 202-208, which compensates the DC gradient along the axis of quadrupole 200. Alternatively, the electrodes 210-216 may be used to eject negatively charged ions from the ion flux 103 on the opposite side of the quadrupole, also separated in accordance with their m/z.

As is shown in FIG. 4, the DC-biased extraction electrodes 202-208 have a slot (i.e. a gap between a pair of aligned DC-biased electrodes) or another suitable aperture or opening to support transferring of the extracted ions to a respective ion storage cell 106-1 to 106-N or mass-analyzing device 202-1 to 202-N, or to an additional ion flux separator 104. Optionally, the mass analyzing devices are selected from suitable devices such as for instance a quadrupole mass filter, a time-of-flight mass analyzer or an orbital trapping analyser.

Figure 5:
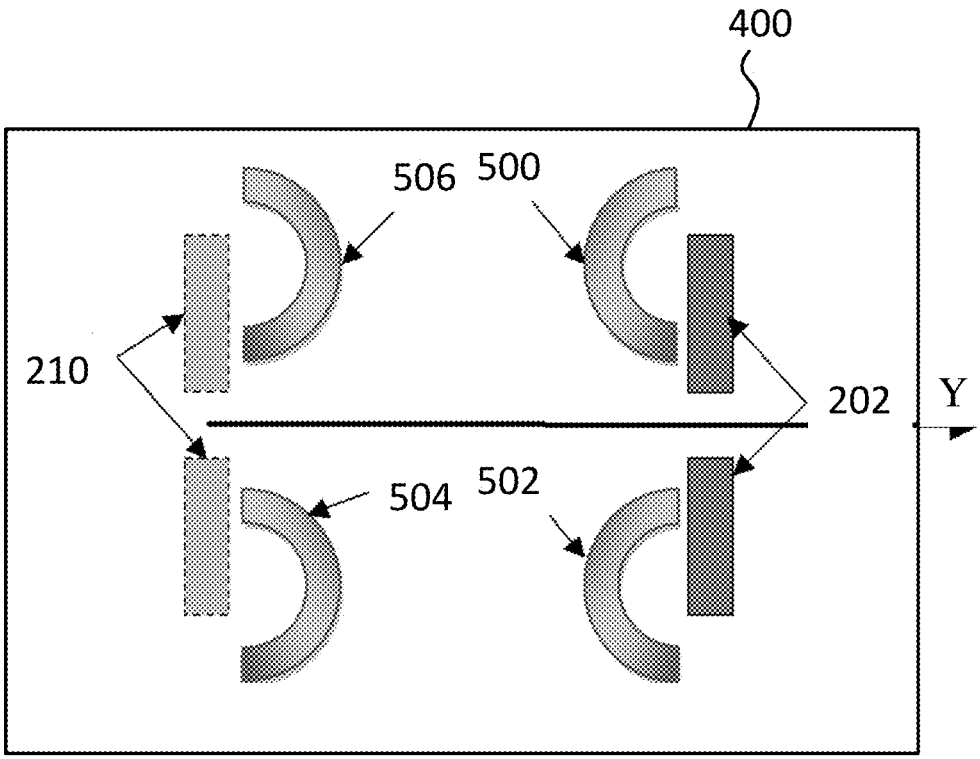
FIG. 5 is a simplified end view showing the electrode arrangement of the ion flux separator of FIG. 4.

Referring now to FIG. 5, shown is a cross-sectional view of electrode arrangement 400 of the ion flux separator 104, taken along line I-I in FIG. 4. The linear quadrupole ion guide 200 comprises electrodes 500, 502, 504 and 506, arranged in opposite pairs. In particular, the electrodes 500-506 are supplied with RF amplitude, wherein the pairs 500/504 and 502/506 have the RF phases shifted by 180 degrees. The DC-biased extraction electrode 202 (with a central aperture) is negatively biased with the voltage $-U_1$ and the optional compensating electrodes 210 are positively biased with the voltage $+U_1$. The axis X is the longitudinal axis of the quadrupole 200, which is orthogonal to the plane of FIG. 5. As such the injected ions 103 propagate into the quadrupole in the positive direction of X, and the absolute value of the voltage U is gradually or step-wise monotonically increased with increasing X. For instance, referring again to FIG. 4 the voltage U is step-wise increased from $U_1$ to $U_2$ to $U_3$ and finally to $U_4$. Ions having a particular m/z ratio are ejected through the space between electrodes 500 and 502, in the positive direction of Y (extraction direction), and out through the aperture in DC-biased extraction electrode 202 when the voltage U overcomes the RF ponderomotive potential for that particular value of m/z ratio.

Figure 6:
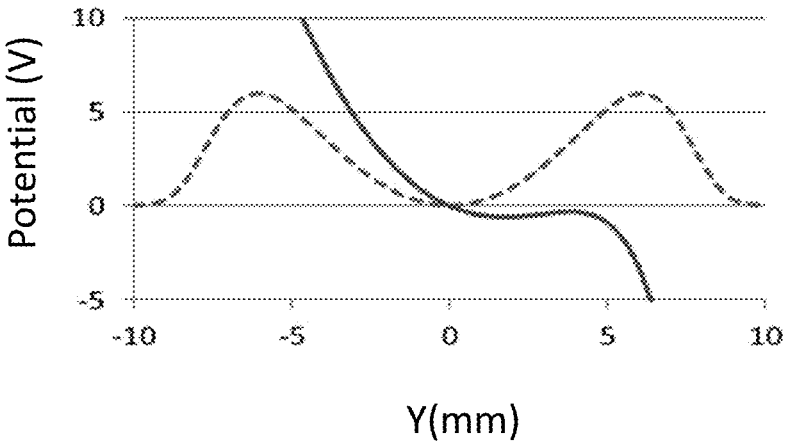
FIG. 6 is a plot showing effective potential in the ion flux separator as a function of Y.

Referring now to FIG. 6, shown is a plot of the RF ponderomotive potential for ions with m/z=524 (dashed line, RF amplitude 400 V peak-to-peak at 1 MHz) as a function of position (Y direction). The solid line in FIG. 6 shows the sum of the RF ponderomotive potential and the DC extraction potential for U=32V, at which the potential barrier disappears on the right and thus allowing the ions with m/z=524 to be extracted from the RF quadrupole 200 along the positive Y-direction through the space between electrodes 500 and 502 and via the aperture in electrode 202.

Optionally, a number of the DC-biased extraction electrodes (and optional compensating electrodes) greater than or less than four may be used, such that a number of discrete extraction regions may be defined along the length of the quadrupole 200 for generating a corresponding number of beams of extracted ions that is suitable for a desired application. Further optionally, a multipole arrangement other than a quadrupole may be used, such as for instance a hexapole or an octapole. Further optionally, the DC-biased extraction electrodes are provided as pairs of extraction electrodes separated by a space defining a gap through which the ions are extracted. Further optionally, more than one electrical controller is used for applying the potentials to the electrodes of the electrode arrangement 400. One of skill in the art will readily appreciate that various ion optic components, vacuum chambers, electrode supports, insulators, housings etc., which are not necessary for achieving an understanding of the operating principles of the ion flux separator 104, have been omitted in FIG. 4.

Figure 7:
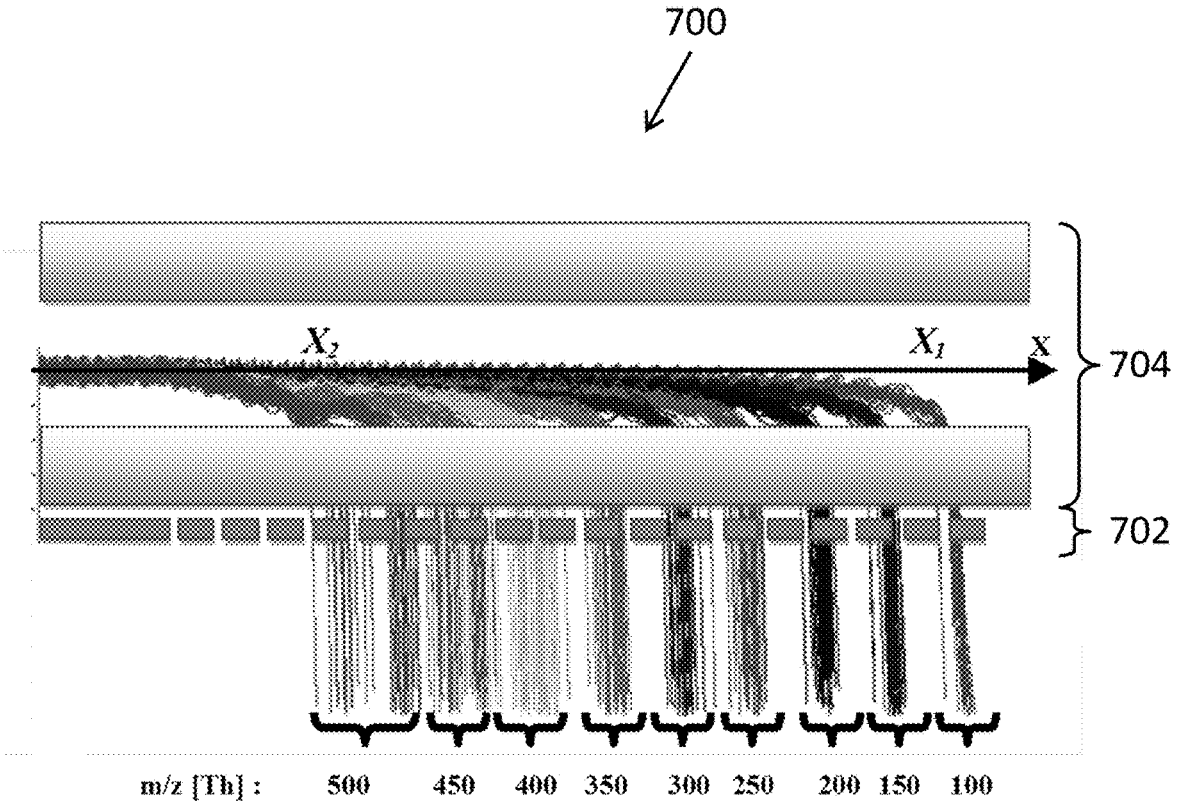
FIG. 7 is a simplified diagram illustrating the extraction of ions, having different mass-to-charge ratios ranging from $m_1$=100 Th to $m_2$=500 Th, from an ion separator according to an embodiment.

FIG. 7 is a simplified diagram showing an electrode arrangement 700 that is similar to electrode arrangement 400, but with an increased number of extraction electrode segments 702. In the example that is shown in FIG. 7 nine discrete extraction regions have been defined along the length of the quadrupole assembly 704, such that ions with different mass-to-charge ratios, ranging from $m_1$=100 Th to $m_2$=500 Th, are extracted along the X direction of quadrupole 704 between $X_1$ and $X_2$. For illustrative purposes, the ions with m/z being multiples of 50Th are only shown. The extraction DC potential U is distributed according to equation (1):

$$U(X) = U_1 \frac{m_1(X_1 - X_2)}{m_1(X - X_2) + m_2(X_1 - X)} \quad (1)$$

where $U_1$ is the DC voltage at which the ponderomotive potential barrier is overcome for the ions with mass-to-charge ratio $m_1$. Since the extraction DC potential distribution is inversely proportional to the m/z ratio m* of the ions to be extracted, the extracted mass m*(X) is therefore linearly distributed between $X_2$ and $X_1$.

Figure 8A:
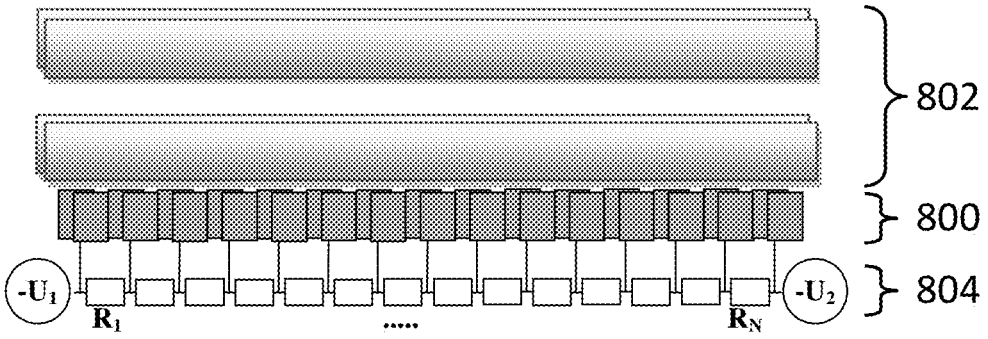
FIG. 8A illustrates a first electrode arrangement for producing a non-constant extraction field along a quadrupole.
Figure 8B:
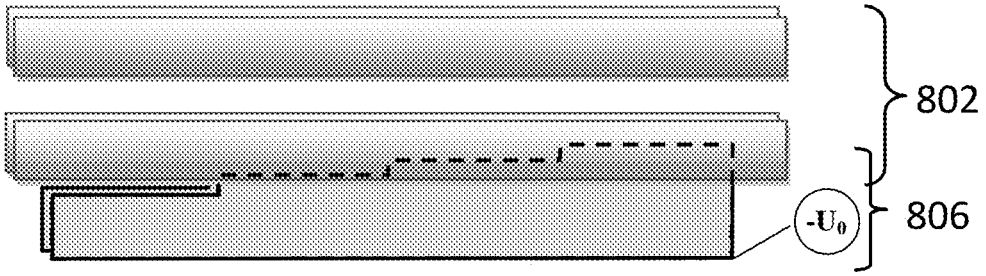
FIG. 8B illustrates a second electrode arrangement for producing a non-constant extraction field along a quadrupole.
Figure 8C:
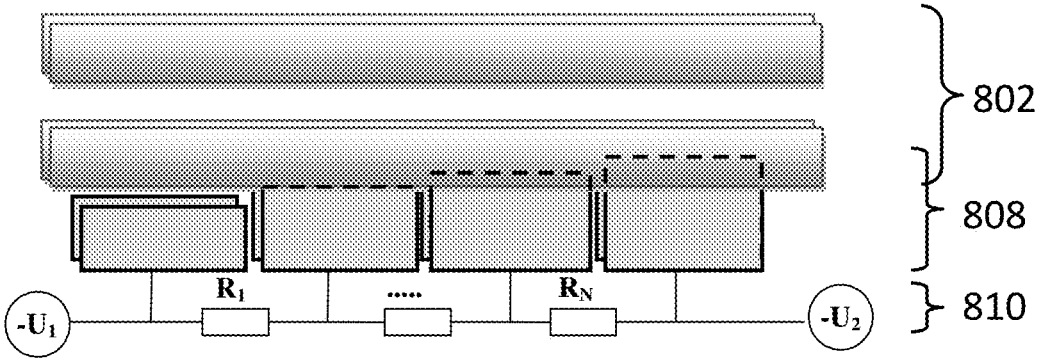
FIG. 8C illustrates a third electrode arrangement for producing a non-constant extraction field along a quadrupole.

FIGS. 8A-8C illustrate several alternative electrode arrangements that are suitable for establishing the DC electric field in an ion flux separator, according to embodiments of the invention.

In the embodiment that is shown in FIG. 8A, a plurality of extraction electrode segments 800 is arranged adjacent to the quadrupole 802. Each extraction electrode segment has a different voltage applied thereto, ranging between $-U_1$ nearest the ion introduction end to $-U_2$ at the opposite end. The illustrated arrangement may be used to provide a linear or non-linear increase of the voltage on the extraction electrodes 800, e.g. with the use of a resistive voltage divider 804. Optionally, the size of each extraction electrode segment may be relatively small to generate a quasi-continuous field distribution, or relatively large to generate a step-wise field distribution. Further optionally, if the extraction electrodes are manufactured from a resistive material, then the extraction electrodes themselves may perform the function of a voltage divider.

In the embodiment that is shown in FIG. 8B, a single stepped (shaped) extraction electrode 806 is arranged adjacent to the quadrupole 802. The voltage $U_0$ is applied to electrode 806, but the electrode 806 gradually or step-wise changes distance to the quadrupole 802, so that the DC field penetration monotonically changes along the quadrupole 802.

The embodiment that is shown in FIG. 8C is a combination of the embodiments depicted in FIGS. 8A and 8B. More particularly, a plurality of extraction electrode segments 808 is arranged adjacent to the quadrupole 802. Each extraction electrode segment has a different voltage applied thereto, ranging between $-U_1$ nearest the ion introduction end to $-U_2$ at the opposite end. The illustrated arrangement may be used to provide a linear or non-linear increase of the voltage on the extraction electrodes, e.g. with the use of a resistive voltage divider 810. In addition, the distance between the electrodes 808 and the quadrupole 802 gradually or step-wise changes, so that the DC field penetration monotonically changes along the quadrupole 802. Optionally, the size of each extraction electrode segment may be relatively small to generate a quasi-continuous field distribution, or relatively large to generate a step-wise field distribution. Further optionally, if the extraction electrodes are manufactured from a resistive material, then the extraction electrodes themselves may perform the function of a voltage divider.

Figure 9:
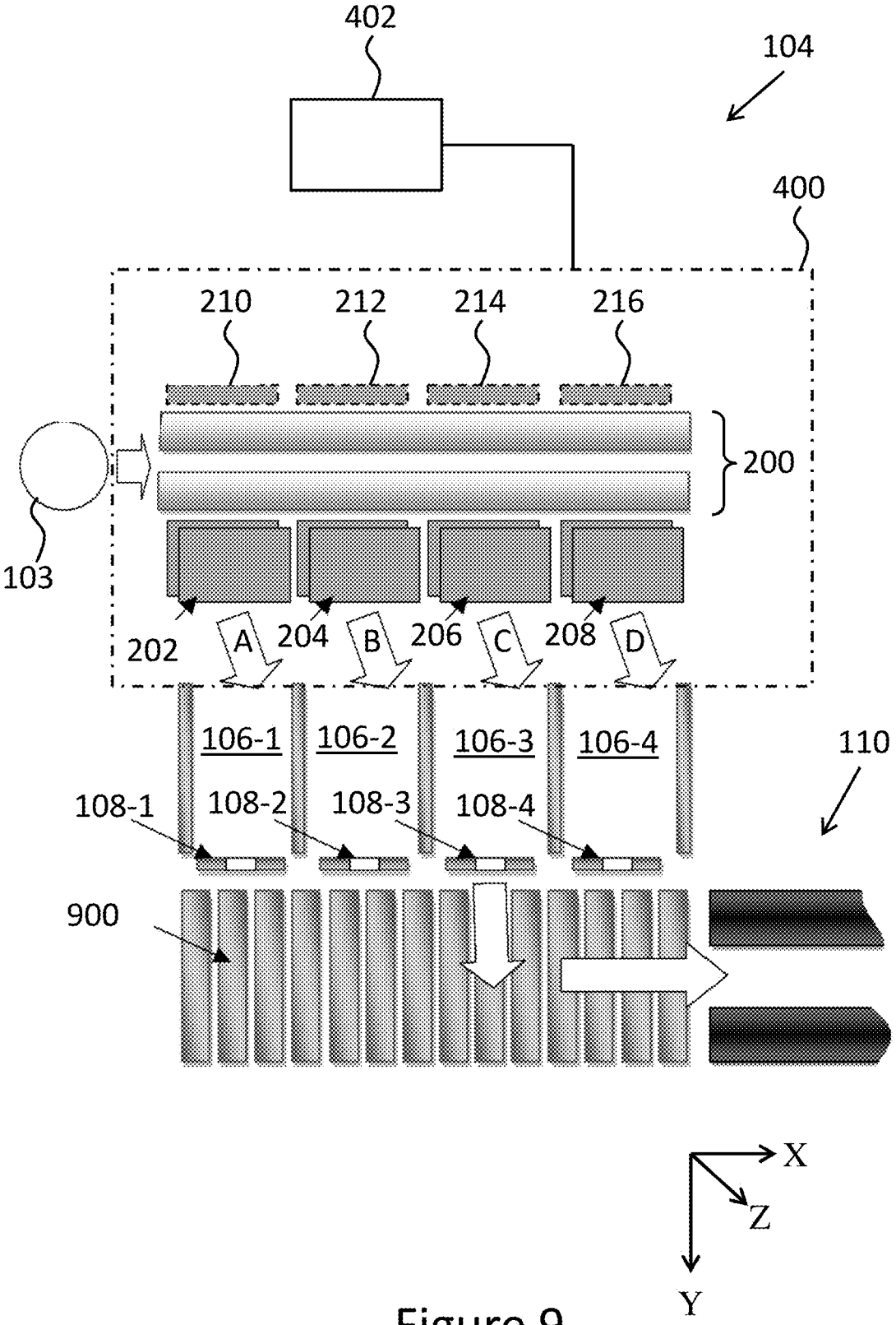
FIG. 9 illustrates the ion flux separator of FIG. 4 in a tandem arrangement with a scanning mass analyzer, with an ion transport device disposed therebetween.

FIG. 9 is a simplified diagram showing ion flux separator 104 arranged relative to a scanning analyzing quadrupole 110. The ion flux 103 is introduced into a central space within quadrupole 200 of ion flux separator 104, and is separated into a plurality of beams of extracted ions (beamlets) based on the ion mass-to-charge ratios, as discussed above with reference to FIGS. 1-8. The beamlets are extracted at locations A-D along the X-direction of the quadrupole 200, and are extracted along the Y-direction passing through DC-biased extraction electrodes 202-208, and being cooled and captured in separate gas-filled ion cells or traps 106-1 to 106-4, respectively. Voltages on diaphragms (gates) 108-1 to 108-4 control the trapping of the ions within the ion traps 106-1 to 106-4, respectively. Initially, the gates 108-1 to 108-4 are positively biased, such that all of the ion beamlets are accumulated within respective ion traps 106-1 to 106-4. The gates 108-1 to 108-4 are then opened, one at a time, by removing the positive voltage that is applied thereto. The stored ions exit from each of the ion traps 106-1 to 106-4 in a time-sequence, penetrate to an ion transport device 900, and are transferred to the entrance of the analyzing quadrupole 110. By way of a specific and non-limiting example, the ion transport device is "moving latch" 900, i.e. an RF-AC ion transfer device such as described by Kovtoun in US 2012/0256083, the entire contents of which are incorporated herein by reference. The ion cell/trap guides can have additional means of containing or flushing out accumulated ions. This can be achieved by using various methods known in the art, such as resistive coatings with continuous DC gradient or the drag vanes adjacent to the main rods.

The various ion flux separator electrode configurations, as described above, are capable of separating ions within a mass range that is limited by the choice of the RF amplitude and frequency. Sufficiently high RF amplitude and sufficiently low frequency are required to handle the ions with the highest m/z values and to constrain them in the RF quadrupole 200. On the other hand, the ponderomotive potential barrier becomes too high for the ions with the lowest m/z values, and these ions may become fragmented during collisions with residual gas when they are extracted, or their extraction may require unacceptably high DC voltages.

The above-mentioned limitations may be overcome, and the working mass range may effectively be extended, by operating two or more ion flux separators in series, so that a subsequent ion flux separator receives from the distant end of a preceding ion flux separator those ions whose m/z ratio is smaller than can be extracted using the maximum DC field in the preceding separator. More than two ion flux separators may be disposed in such a tandem arrangement, with each subsequent quadrupole section having a progressively smaller RF amplitude and/or higher RF frequency.

Figure 10:
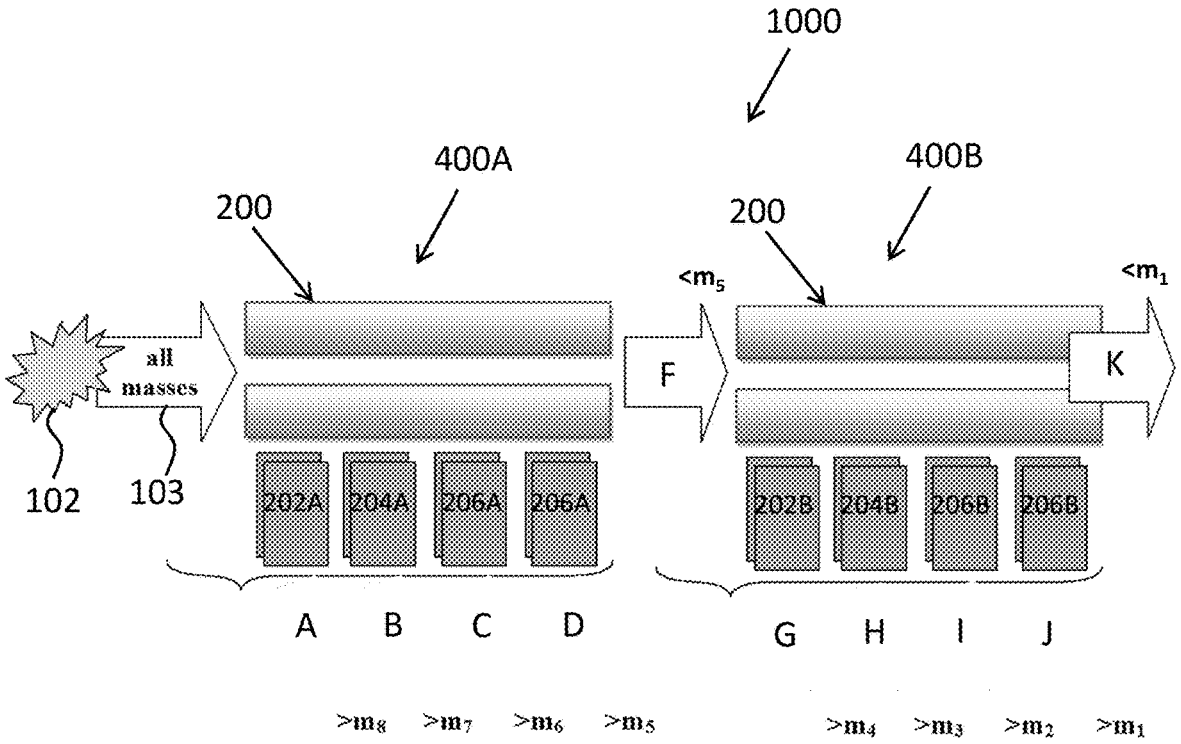
FIG. 10 illustrates two ion flux separators of FIG. 4 disposed in a tandem arrangement.

This tandem arrangement is illustrated in FIG. 10, which shows a system 1000 comprising two separate arrangements of electrodes 400A and 400B. The electrodes 400A separate ions in the m/z ratio range $m_5$-$m_8$ from the ion flux 103 produced by the source 102. Ions with an m/z ratio lower than $m_5$ are not extracted by any of the electrodes 202A-208A at locations A-D of the first electrode arrangement 400A. Rather, these relatively lower m/z ratio ions exit the first electrode arrangement 400A at location F and are received within the second electrode arrangement 400B, which then separates the relatively lower m/z ratio ions in the m/z ratio range $m_1$-$m_4$ at locations G-J. The remaining ions, with m/z ratios less than $<m_1$, exit the second electrode arrangement 400B at location K. Of course, additional sections of electrode arrangements may be added if required to perform further separation of the ions with m/z ratios less than $<m_1$. For clarity, only the electrode arrangements 400A and 400B of the ion flux separators have been illustrated in FIG. 10.

FIGS. 11 through 14 illustrate alternative electrode configurations, which may be utilized in an ion flux separator according to an embodiment of the invention, and which in particular do not include separate DC-biased extraction electrodes or compensating electrodes.

Figure 11A:
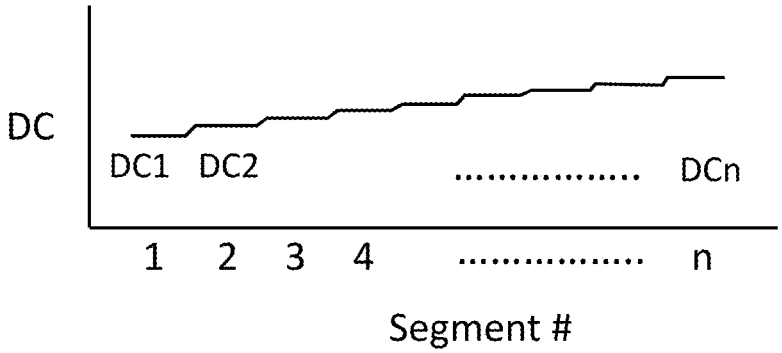
FIG. 11A is a plot showing DC as a function of electrode segment number for the electrode arrangement shown in FIG. 11B.
Figure 11B:
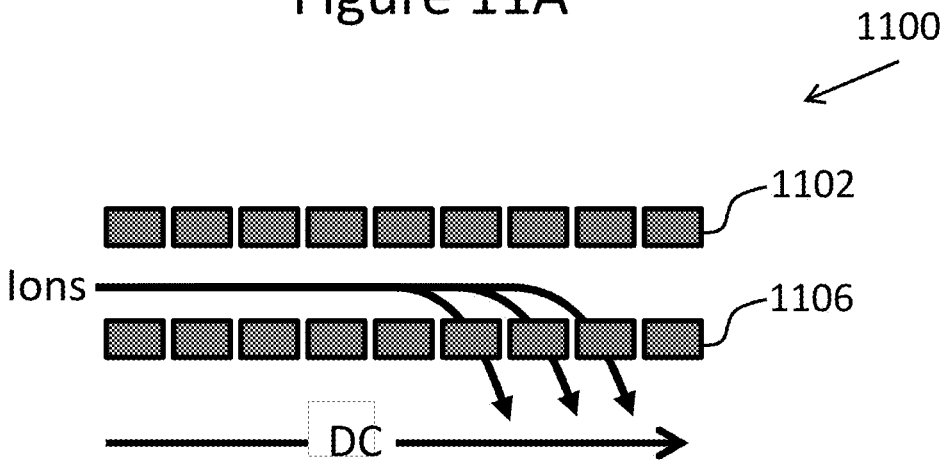
FIG. 11B is a simplified side view of an alternative electrode arrangement for separating ions according to an embodiment.
Figure 11C:
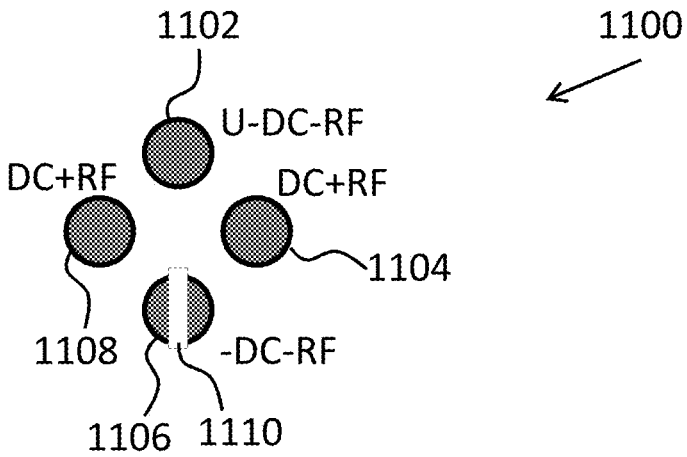
FIG. 11C is a simplified end view of the electrode arrangement of FIG. 11B.

Referring to FIGS. 11B and 11C, shown are simplified side and end views, respectively, of an electrode arrangement 1100 for an ion flux separator according to an embodiment. The electrode arrangement 1100 includes a quadrupole arrangement of segmented electrodes 1102-1108. Referring also to FIG. 11A, the electrode arrangement 1100 is operated in quadrupole (parametric resonance) mode with a step-wise increasing resolving DC level being applied segment-to-segment along the ion transmission direction, resulting in ejecting the highest m/z ions first (the lowest q) and the lowest m/z ions last. Ions are ejected through a slot 1110 in the segments of the segmented electrode 1106. Collision with the segment of the opposite segmented electrode 1102 is avoided by applying a small retarding voltage U, as illustrated in FIG. 11B, or by introducing geometrical asymmetry between these electrodes.

Figure 11D:
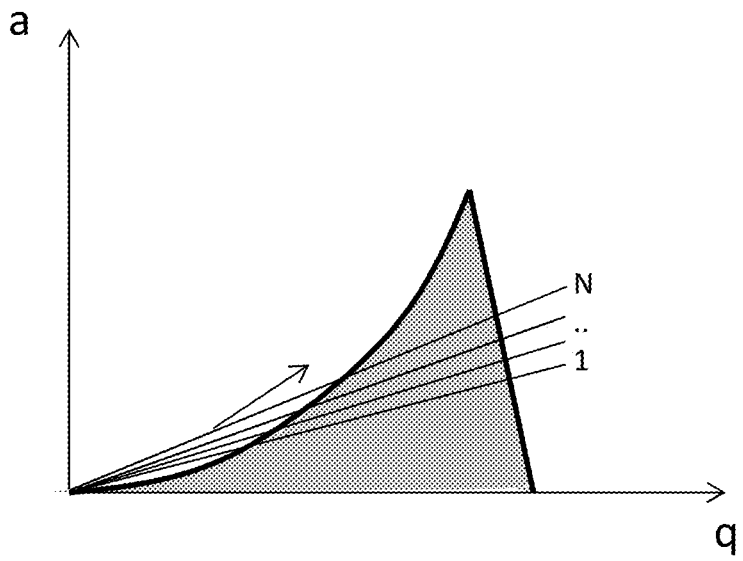
FIG. 11D illustrates the evolution of the working line in a Mathieu stability diagram with increasing ion transmission distance into the electrode arrangement shown in FIGS. 11B and 11C.

For quadrupole mass filters, "a" and "q" for ejection can be predicted based on a Matthieu stability diagram, with different m/z values being distributed along the "working line." FIG. 11D shows the evolution of the working line as ions move deeper into the electrode arrangement 1100. The proposed arrangement ejects ions that correspond to the intersection of the working line with the left edge of the the triangle of stability. In U.S. Pat. No. 7,196,327, Thomson and Loboda discuss a mass-spectrometer with spatial resolution, which comprises an RF quadrupole having rods that converge from the ion entrance end towards the opposite end, so that the effective radius $r_0$ decreases gradually along the length of the quadrupole. An ion with a particular mass-to-charge ratio will be ejected at a particular distance from the entrance end, where its parameter q goes beyond the stability limit $q \approx 0.908$ (i.e. on the right edge of the triangle of stability). Comparing to the proposed solution, a drawback of this approach is that the quadrupole trap operates at high values of Q, which leads to a wide energy spread of ejected ions. It is also important that changing $r_0$ makes it difficult to interface such design to an array of traps as traps should all become different to match to the changing $r_0$.

Figure 12A:
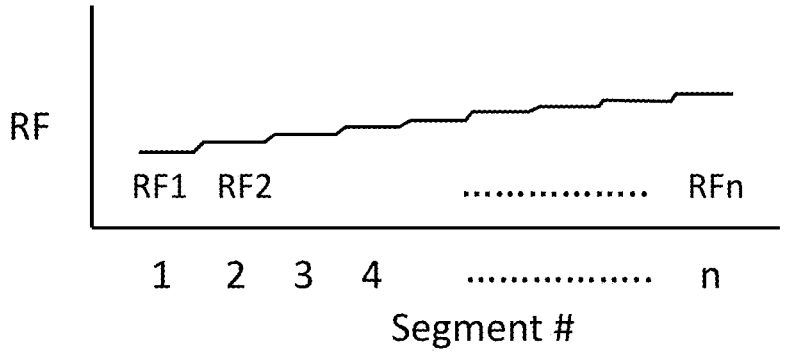
FIG. 12A is a plot showing RF as a function of electrode segment number for the electrode arrangement shown in FIG. 12B.
Figure 12B:
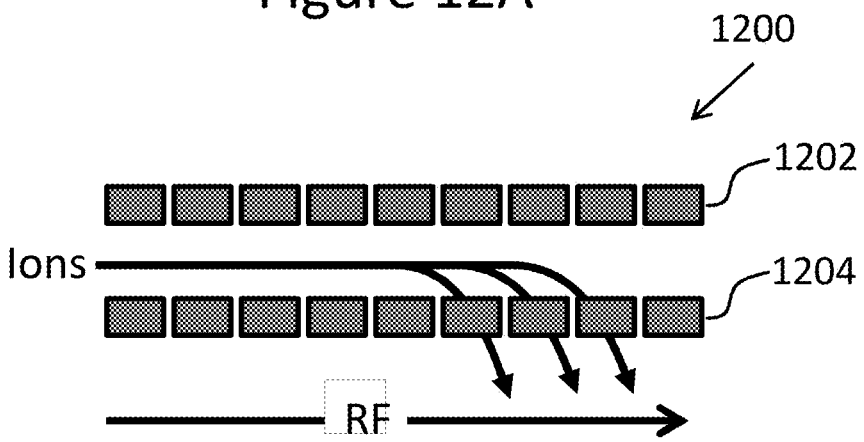
FIG. 12B is a simplified side view of an alternative electrode arrangement for separating ions according to an embodiment.
Figure 12C:
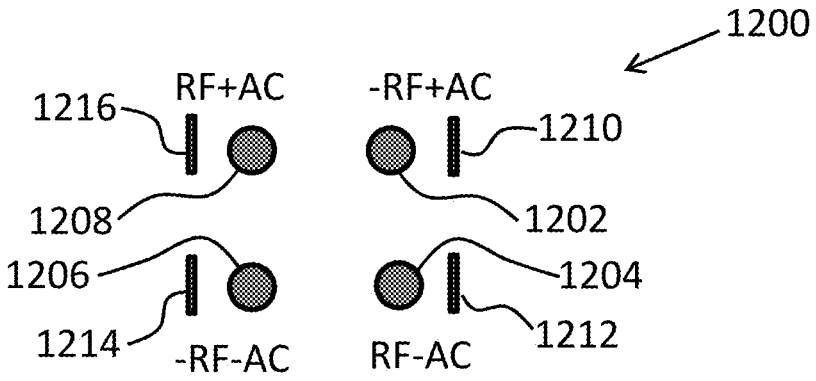
FIG. 12C is a simplified end view of the electrode arrangement of FIG. 12B.

FIGS. 12B and 12C are simplified side and end views, respectively, of an electrode arrangement 1200 for an ion flux separator according to an embodiment. The electrode arrangement 1200 includes a quadrupole arrangement of segmented electrodes 1202-1208 with RF only (no DC) applied to them. In addition, as shown only in FIG. 12C, electrodes 1210-1216 are used to apply AC dipolar excitation across the pairs of electrodes, thereby enabling ion ejection between the rods 1204 and 1206. Alternatively, the AC dipolar excitation is applied between opposing rods, thereby causing ejection to occur through one of the rods as in linear traps. The AC and RF are applied at fixed frequencies, and therefore ions at a certain q0 are excited. The AC amplitude and phase are also fixed.

Now referring also to FIG. 12A, a step-wise increasing RF level applied segment-to-segment results in increasing q for a particular m/z. As an ion having this m/z reaches q0 of excitation, it gets ejected, therefore the lowest mass ions are ejected first, since they see the lowest pseudo-potential barrier, and highest mass ions are ejected last, so that RF/(q0*m/z)=const. The absence of DC results in reduced ejection energies of the extracted ions. An alternative arrangement could have RF decreasing along the electrode arrangement 1200, thus allowing usage of low q0 and hence lower energies of ejection.

Figure 13A:
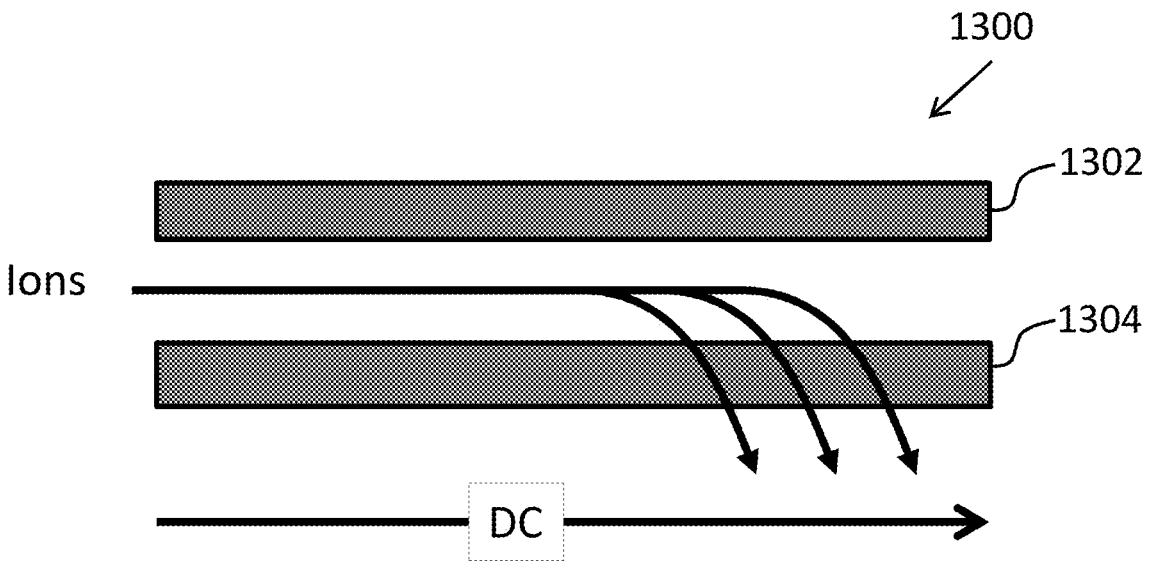
FIG. 13A is a simplified side view of an alternative electrode arrangement for separating ions according to an embodiment.
Figure 13B:
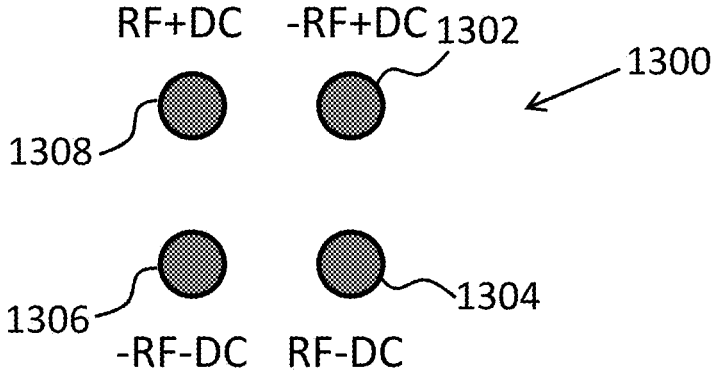
FIG. 13B is a simplified end view of the electrode arrangement of FIG. 13A.

Referring now to FIGS. 13A and 13B, shown are simplified side and end views, respectively, of an electrode arrangement 1300 for an ion flux separator according to an embodiment. The electrode arrangement 1300 includes a quadrupole arrangement of electrodes 1302-1308. Monotonically increasing attractive DC is applied to electrodes 1304 and 1306, while the opposite sign DC of the same magnitude is applied to the electrodes 1302 and 1308. Quadrupolar RF is applied to all four rods 1302-1308. As the DC voltage increases along the length of the electrodes 1302-1308, at a certain point it exceeds the maximum pseudopotential caused by the RF voltage that retains the ions within the quadrupole. The ions subsequently exit the electrode arrangement 1300 at respective locations determined by their m/z ratio similarly to embodiment of FIGS. 4-9 but with DC distribution defined by the same rods that define RF. Various approaches for increasing the DC potential along the length of the electrode arrangement 1300 may be envisaged. For instance, electrode arrangement 1300 may be fabricated using resistively coated rods 1302-1308.

Figure 14A:
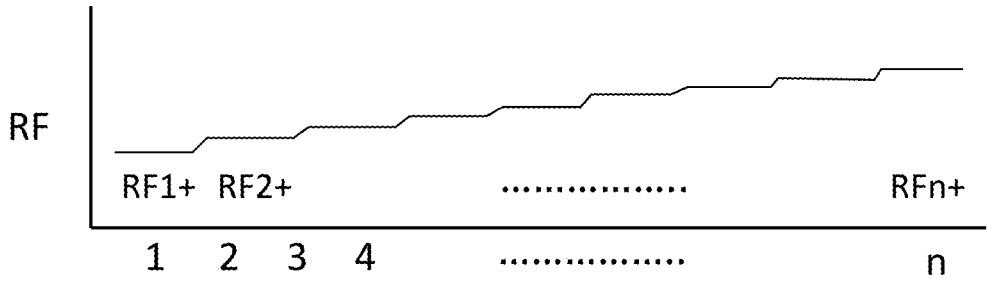
FIG. 14A is a plot showing RF as a function of electrode segment number for the electrode arrangement shown in FIG. 14B.
Figure 14B:
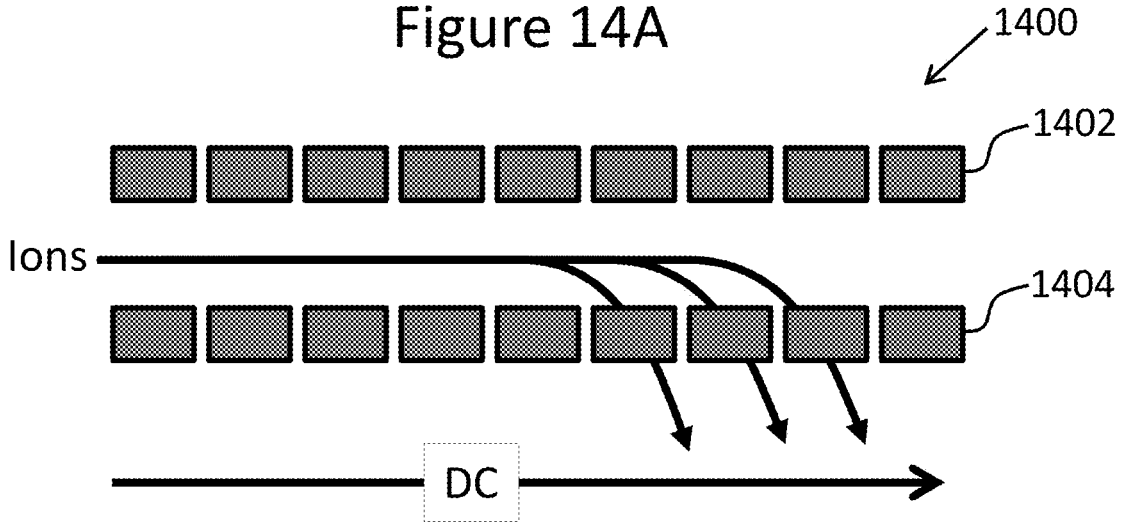
FIG. 14B is a simplified side view of an alternative electrode arrangement for separating ions according to an embodiment.
Figure 14C:
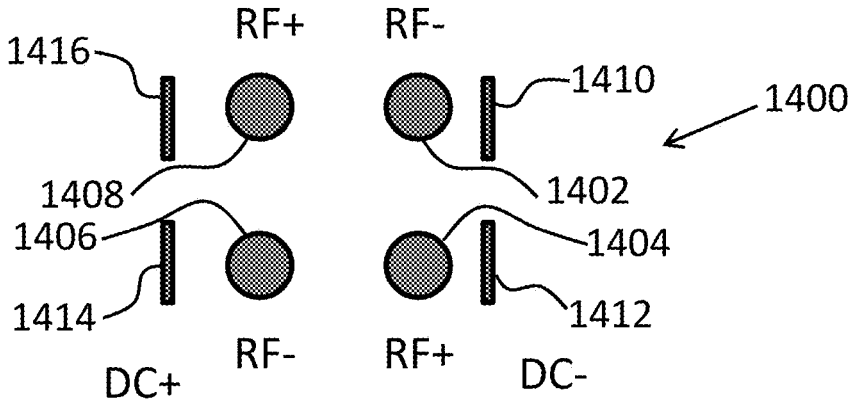
FIG. 14C is a simplified end view of the electrode arrangement of FIG. 14B.

Referring now to FIGS. 14B and 14C, shown are simplified side and end views, respectively, of an electrode arrangement 1400 for an ion flux separator according to an embodiment. The electrode arrangement 1400 includes a quadrupole arrangement of segmented RF electrodes 1402-1408 and an arrangement of DC electrodes 1410-1416. As shown in FIG. 14A, monotonically increasing RF is applied segment-to-segment causing the highest m/z ratio ions to be ejected first, since they see the lowest pseudo-potential barrier, and the lowest m/z ratio ions to be ejected last. The voltage difference between DC+ and DC− is held constant along the quadrupole axis, but DC on segments with different RF level is also increased to compensate for the pseudo-potential barriers between segments resulting from the stepped RF levels. The inter-segment DC gradient may be relatively small because ions move close to the axis, where pseudo-potential field is rather small. Alternatively, DC gradients between segments could be introduced on the top of RF gradients. This DC gradient must be compensated by introduction of the compensatory DC gradient on external DC electrodes to hold DC difference between RF segments and DC plates constant or simply by tilting or shaping the external DC electrodes.

The foregoing description of methods and embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

Embodiments described above provide the greatest benefit in combination with tandem mass spectrometers such as hybrid arrangement including a quadrupole mass filter, a collision cell and either time-of-flight or orbital trapping or FT ICR or another quadrupole mass filter, or hybrid arrangement including a linear ion trap and any of the analyzers above, or any combination thereof. Decoupling of analysis process from the process of building up ion populations for such analysis is the main advantage of the proposed approach and this allows to run downstream mass analyzers at maximum speed essentially independent of intensity of ions of interest. This enables a number of advanced acquisition methods such as data-dependent acquisition, data-independent acquisition, trace analysis, peptide quantitation, multi-residue analysis, top-down and middle-down analysis of proteins, etc.

What is claimed is:

1. An apparatus for mass spectrometry analysis, comprising:

an electrode arrangement having a length extending in an axial direction between a first end thereof and a second end thereof, the second end opposite the first end, and the first end being configured to introduce a continuous beam of ions into an ion transmission space of the electrode arrangement, the beam of ions comprising ions having m/z ratios within a first range of m/z ratios; and, an electronic controller in electrical communication with the electrode arrangement and configured to apply an RF potential and a DC potential to at least an electrode of the electrode arrangement, wherein the generated electric field supports the extraction of ions having different m/z values at respective different positions along the length of the electrode arrangement, in one of increasing and decreasing sequential order of m/z ratio with increasing distance from the first end, wherein the continuous beam of ions is split into a plurality of spatially separate ion beamlets of narrower m/z ratio ranges than the first range of m/z ratios, stored in separate independently controlled ion storage cells, released from each storage cell when a predetermined amount of ions have accumulated in the storage cells and analyzed in at least one mass analyzer.

2. The apparatus of claim 1 wherein the electronic controller generates a ponderomotive RF electric field and a mass-independent DC electric field, such that a ratio of the strength of the ponderomotive RF electric field to the strength of the mass-independent DC electric field in a transverse dimension orthogonal to the axial direction varies along the length of the electrode arrangement.

3. The apparatus of claim 2 comprising at least one DC-biased extraction electrode disposed adjacent to a first side of the quadrupole electrode assembly for controlling the DC electric field within the ion transmission space of the electrode arrangement, the at least one DC-biased extraction electrode defining a plurality of discrete extraction regions of the quadrupole electrode assembly, wherein each discrete extraction region supports the extraction of a subset of the continuous beam of ions, each subset forming a beamlet of ions having m/z ratios within a different predetermined range of m/z ratios.

4. The apparatus of claim 3 wherein the at least one DC-biased extraction electrode comprises a plurality of DC-biased extraction electrodes.

5. The apparatus of claim 3 wherein the at least one DC-biased extraction electrode comprises a shaped-electrode with one edge having a plurality of protruding portions, wherein the spacing between the quadrupole electrode assembly and each protruding portion decreases monotonically along the length of the electrode arrangement from the first end to the second end, and wherein the electronic controller is configured to apply the DC potential to the shaped-electrode.

6. The apparatus of claim 1 wherein the electrode arrangement comprises a quadrupole electrode assembly comprising a substantially parallel arrangement of four segmented, rod-shaped electrodes, the electronic controller being configured to apply the RF potential to segments of at least some of the segmented rod-shaped electrodes.

7. The apparatus of claim 6 wherein the segments of one of the four segmented, rod-shaped electrodes have an aperture extending therethrough for supporting extraction of the ions, and wherein the electronic controller is configured to apply the DC potential to the segments of the one of the rod-shaped electrodes as a series of DC potentials that increase monotonically from one segment to next in a direction from the first end toward the second end.

8. A mass spectrometer system, comprising:

a continuous flux ion source for producing a continuous beam of ions comprising ions having a first range of mass-to-charge (m/z) ratios;

an ion flux separator disposed in fluid communication with the ion source and comprising:

an electrode arrangement having a length extending in an axial direction between a first end thereof and a second end thereof, the second end opposite the first end, and the first end configured to introduce the continuous beam of ions from the continuous flux ion source into an ion transmission space of the electrode arrangement;

wherein the electrode arrangement comprises a single quadrupole electrode assembly comprising a substantially parallel arrangement of four non-segmented, rod-shaped electrodes; and, wherein the electronic controller is configured to apply the RF potential to at least some of the non-segmented rod-shaped electrodes; and, an electronic controller in electrical communication with the electrode arrangement and configured to apply an RF potential and a DC potential to at least an electrode of the electrode arrangement forming a plurality of separate ion beamlets, each ion beamlet having m/z ratios within a different second range of m/z ratios, and each second range of m/z ratios being within the first range of m/z ratios;

at least one mass analyzer in fluid communication with the ion flux separator for receiving separately each one of the separate ion beamlets; and, wherein the continuous beam of ions is split into a plurality of spatially separate ion beamlets of narrower m/z ratio ranges than the first range of m/z ratios, stored in separate independently controlled ion storage cells, released from each storage cell when a predetermined amount of ions have accumulated in the storage cells and analyzed in at least one mass analyzer.

9. The mass spectrometer system of claim 8 wherein the at least one mass analyzer comprises a plurality of sequential mass analyzers in fluid communication with the ion flux separator, each one of the plurality of sequential mass analyzers for receiving a different one of the plurality of separate ion beamlets, wherein each sequential mass analyzer analyzes the range of m/z ratios corresponding to the ion beamlet that is received thereby.

10. The mass spectrometer system of claim 8 comprising a plurality of ion storage cells in fluid communication with the ion flux separator, wherein each ion storage cell of the plurality of ion storage cells is disposed between the ion flux separator and a respective one of the plurality of sequential mass analyzers, wherein filling and emptying of each ion storage cell is controlled using a separate gate associated therewith, such that the accumulation of ions within each ion storage cell is independent of the accumulation of ions within other ion storage cells.

11. The mass spectrometer system of claim 8 comprising a plurality of ion storage cells in fluid communication with the ion flux separator, each one of the plurality of ion storage cells for receiving a different one of the plurality of separate ion beamlets.

12. The mass spectrometer system of claim 11 wherein the at least one mass analyzer comprises a common sequential mass analyzer that is in fluid communication with each ion storage cell of the plurality of ion storage cells, the plurality of ion storage cells being disposed between the ion flux separator and the common sequential mass analyzer, each ion storage cell of the plurality of ion storage cells for accumulating ions from the respective different one of the plurality of separate ion beamlets and being controllable independently for providing accumulated ions to the common sequential mass analyzer, such that the common sequential mass analyzer receives ions corresponding to only one of the plurality of separate ion beamlets at a time.

13. The mass spectrometer system of claim 12 comprising an ion transport device disposed between the ion flux separator and the at least one mass analyzer, and further comprising a plurality of ion storage cells disposed between the ion flux separator and the ion transport device, wherein each ion storage cell of the plurality of ion storage cells is arranged to receive a different one of the plurality of separate ion beamlets and to accumulate the ions in said beamlet, each ion storage cell being controllable independently using a separate ion gate, wherein the ions accumulated within each ion storage cell are provided separately to the ion transport device and are thereafter transported to the at least one mass analyzer.

14. The mass spectrometer system of claim 8 wherein the ion flux separator is a first ion flux separator, and comprising a second ion flux separator disposed in a tandem arrangement with the first ion flux separator such that ions having m/z ratios within the first range of m/z ratios and that are not separated in the first ion flux separator are introduced into the second flux separator and are separated therein.

15. A method of mass spectrometry, comprising:

using a continuous flux ion source, producing a continuous beam of ions having mass-to-charge (m/z) ratios within a predetermined first range of m/z ratios;

introducing the continuous beam of ions into an ion flux separator that is disposed between the ion source and at least one mass analyzer, the ion flux separator having a length extending in an axial direction, wherein the ion flux separator comprises a single quadrupole electrode assembly comprising a substantially parallel arrangement of four non-segmented, rod-shaped electrodes;

applying an RF potential and a DC potential to at least an electrode of the ion flux separator, thereby establishing a ponderomotive RF electric field and a mass-independent DC electric field, the RF potential and the DC potential applied such that a ratio of the strength of the ponderomotive RF electric field to the strength of the mass-independent DC electric field in a transverse dimension orthogonal to the axial direction varies along the length of the ion flux separator, wherein applying the DC potential comprises providing at least one DC-biased extraction electrode arranged adjacent to one side of the quadrupole electrode assembly;

extracting ions having different m/z ratios at different respective locations along the length of the ion flux separator, the extracted ions forming a plurality of separate ion beamlets, each ion beamlet consisting essentially of ions having m/z ratios within a different second range of m/z ratios, and each second range of m/z ratios being within the first range of m/z ratios; and, using the at least one mass analyzer, receiving separately each of the plurality of separate ion beams for performing in aggregate an analysis of the introduced ion continuous beam, wherein the continuous beam of ions is split into a plurality of spatially separate ion beamlets of narrower m/z ratio ranges than the first range of m/z ratios, stored in separate independently controlled ion storage cells, released from each storage cell when a predetermined amount of ions have accumulated in the storage cells and analyzed in at least one mass analyzer.

16. The method of claim 15 wherein the at least one DC-biased extraction electrode comprises a plurality of DC-biased extraction electrodes, the spacing between the quadrupole electrode assembly and each DC-biased extraction electrode being substantially uniform, and wherein applying the DC potential comprises applying a series of DC potentials that increases monotonically from one DC-biased extraction electrode to the next, in a direction along the length of the ion flux separator.

17. A method of mass spectrometry, comprising:

using a continuous flux ion source, producing a beam of ions having mass-to-charge (m/z) ratios within a predetermined first range of m/z ratios;

introducing the beam of ions into an ion flux separator that is disposed between the ion source and at least one mass analyzer, the ion flux separator having a length extending in an axial direction, wherein the ion flux separator comprises a single quadrupole electrode assembly comprising a substantially parallel arrangement of four non-segmented, rod-shaped electrodes;

applying an RF potential and a DC potential to at least an electrode of the ion flux separator, thereby establishing a ponderomotive RF electric field and a mass-independent DC electric field, the RF potential and the DC potential applied such that a ratio of the strength of the ponderomotive RF electric field to the strength of the mass-independent DC electric field in a transverse dimension orthogonal to the axial direction varies along the length of the ion flux separator, wherein applying the DC potential comprises providing at least one DC-biased extraction electrode arranged adjacent to one side of the quadrupole electrode assembly;

extracting ions having different m/z ratios at different respective locations along the length of the ion flux separator, the extracted ions forming a plurality of separate ion beamlets, each ion beamlet consisting essentially of ions having m/z ratios within a different second range of m/z ratios, and each second range of m/z ratios being within the first range of m/z ratios; and, using the at least one mass analyzer, receiving separately each of the plurality of separate ion beams for performing in aggregate an analysis of the introduced ion beam, wherein the beam of ions is split into a plurality of spatially separate ion beamlets of narrower m/z ratio ranges than the first range of m/z ratios, stored in separate independently controlled ion storage cells, released from each storage cell when a predetermined amount of ions have accumulated in the storage cells and analyzed in at least one mass analyzer, wherein the spacing between the quadrupole electrode assembly and each DC-biased extraction electrode decreases monotonically from one DC-biased extraction electrode to the next in a direction along the length of the ion flux separator, and wherein applying the DC potential comprises applying the same DC potential to all of the DC-biased extraction electrodes of the plurality of DC-biased extraction electrodes.

18. The method of claim 15 wherein the at least one DC-biased extraction electrode comprises a shaped-electrode with one edge having a plurality of protruding portions, wherein the spacing between the quadrupole electrode assembly and each protruding portion decreases monotonically in a direction along the length of the ion flux separator, and wherein applying the DC potential comprises applying the DC potential to the shaped-electrode.

* * * * *